US009726015B2

(12) United States Patent
Heikkila et al.

(10) Patent No.: US 9,726,015 B2
(45) Date of Patent: Aug. 8, 2017

(54) MINERAL MATERIAL PROCESSING METHOD AND PROCESSING PLANT

(75) Inventors: Juhamatti Heikkila, Tampere (FI); Tuomas Juutinen, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 318 days.

(21) Appl. No.: 14/403,602

(22) PCT Filed: Jun. 8, 2012

(86) PCT No.: PCT/FI2012/050575

§ 371 (c)(1),
(2), (4) Date: Nov. 25, 2014

(87) PCT Pub. No.: WO2013/182734

PCT Pub. Date: Dec. 12, 2013

(65) Prior Publication Data

US 2015/0292327 A1 Oct. 15, 2015

(51) Int. Cl.

| | |
|---|---|
| ***B02C 21/02*** | (2006.01) |
| ***E21F 13/00*** | (2006.01) |
| ***B02C 23/18*** | (2006.01) |
| ***E21F 5/02*** | (2006.01) |

(52) U.S. Cl.

CPC ..... *E21F 13/002* (2013.01); *B02C 21/02* (2013.01); *B02C 23/18* (2013.01); *E21F 5/02* (2013.01)

(58) Field of Classification Search

CPC ..... B02C 21/02; B02C 23/18; E21F 13/002
USPC ..... 241/62, 65–66
See application file for complete search history.

(56) References Cited

U.S. PATENT DOCUMENTS

| | | | |
|---|---|---|---|
| 2,743,095 | A | 4/1956 | Wright |
| 5,330,671 | A | 7/1994 | Pullen et al. |
| 5,462,237 | A | 10/1995 | Wellmann |
| 2004/0050987 | A1 | 3/2004 | Rossi, Jr. |

FOREIGN PATENT DOCUMENTS

| | | | |
|---|---|---|---|
| AU | 510776 | B2 | 7/1980 |
| JP | 45-21685 | S | 8/1970 |
| JP | 2004344814 | A | 12/2004 |
| JP | 2008183471 | | 8/2008 |
| JP | 2010151105 | A | 7/2010 |
| SU | 1032197 | | 7/1983 |

OTHER PUBLICATIONS

PCT International Search Report dated Feb. 20, 2013.

(Continued)

*Primary Examiner* — Faye Francis
(74) *Attorney, Agent, or Firm* — Andrus Intellectual Property Law, LLP

(57) ABSTRACT

In a mineral material processing method, mineral material is processed in a mineral material processing plant. Heat generated in heat sources of the processing plant and/or fuel used in a motor of the processing plant is cooled in a cooler of the processing plant. The cooler is equipped with a blower. Wetting water is directed to the mineral material for binding dust generated in the processing. Heat of at least one heat source of the processing plant and/or heat of the fuel is transferred to the wetting water before using the wetting water for dust binding. The wetting water is directed, before the dust binding, to a first heat exchanger for receiving heat in the wetting water.

17 Claims, 3 Drawing Sheets

(56) References Cited

OTHER PUBLICATIONS

Written Opinion of the International Searching Authority dated Feb. 20, 2013.
Translated Office Action from JP Patent Application No. 2015-515557.
Notice of Allowance for Russian Patent Application No. 2014150993/13(081701) dated Jun. 27, 2016.

MINERAL MATERIAL PROCESSING METHOD AND PROCESSING PLANT

CROSS-REFERENCE TO RELATED APPLICATIONS

This application claims priority to PCT/FI2012/050575, filed Jun. 8, 2012, and published in English on Dec. 12, 2013 as publication number WO 2013/182734, incorporated herein by reference.

TECHNICAL FIELD

The invention relates to a mineral material processing method and a processing plant.

BACKGROUND ART

Mineral material, for example rock, is gained from the earth for processing by exploding or excavating. The mineral material can also be natural rock and gravel or construction waste such as concrete or bricks, or asphalt. Mobile crushers and stationary crushing applications are used in crushing. An excavator or wheeled loader loads the material to be crushed into the crusher's feed hopper from where the material to be crushed may fall in a jaw of a crusher or a feeder moves the rock material towards the crusher.

A mineral material processing plant comprises one or more crushers and possibly other apparatuses such as screens. The processing plant may be stationary or movable.

FIG. 1 shows a mineral material processing apparatus, a mobile crushing plant 200 that comprises as the main processing apparatus a jaw crusher 100 for crushing of mineral material. The crushing plant 200 has a feeder 103 for feeding the material to be processed to the jaw crusher 100 and a belt conveyor 106 for transporting the crushed material farther from the crushing plant.

The belt conveyor 106 shown in FIG. 1 comprises a belt 107 adapted to pass around at least one roller 108. The crushing plant 200 also comprises a motor 104 and a control unit 105. The motor 104 can be, for example, a diesel motor that provides energy for use of process units and hydraulic circuits.

The feeder 103, the crusher 100, the motor 104 and the conveyor 106 are attached to a body 101 of the crushing plant which body in this embodiment comprises additionally a track base 102 for moving the crushing plant 200. There is known also an entirely or partly wheel based processing plant or a processing plant movable on legs. A mineral material processing plant is also known that is movable/towable by a truck or another external power source.

Mineral material processing such as feeding, screening, crushing and transporting incurs heat in actuators of the processing plant. The actuators such as a motor, lubrication apparatus and hydraulics are heat sources that are cooled by a cooler. FIG. 2 shows a known combination cell 10 that is arranged in the cooler of the processing plant. The combination cell 10 is layer-like such that there are arranged on top of each other in the same structure a charge air cooling cell 11 for cooling 1 of charge air, a fuel cooling cell 12 for cooling 2 fuel, a motor cooling liquid cooling cell 13 for cooling 3 the motor and a hydraulics cooling cell 14 for cooling 4 hydraulic oil of the hydraulics.

It is attempted to economically utilize the capacity of the processing plant to the full extent so that the crusher is continuously loaded with a great crushing power. The running time of processing plants is limited by administrative orders because of noise emissions particularly in urban environment.

A substantial noise emission is caused by a blower that is arranged in connection with the combination cell 10 by which blower the cooling is enhanced by blowing air through the combination cell. Half of the noise emission of the motor is estimated to be blower noise. High rotation speed required from the blower is difficult in a hydraulically driven cooling solution which rotation speed is determined by the greatest cooling demand. The determining factor is typically the cooling demand of the charge air, although its percentage of the combination cell 10 is relatively small (20 to 25%). Thus, the large sized blower of the cooler can rotate with full speed although there would be no need for cooling the hydraulics and the motor.

In the mineral material processing, air flow moves fine particles formed by the processing, and it is attempted to restrict the generating dust emission by dust binding. Dust prevention of processing plants such as crushing plants is often based on water spraying. Water is sprayed to a dust making point of the process such as a crushing chamber of the crusher for example with high pressure 200 to 300 l/h or without high pressure about the threefold relative to the previous. In cold circumstances water-based dust binding causes additional costs and requires use of heating solutions and possible additive agents. It is known to use as a heater an electrical resistor or return oil or leak flow of the hydraulics. If the water is placed in a water tank in a movable processing plant, it is a typical solution is to use the electrical resistor for frost-prevention of the water. Supply of electricity is, however, not self-evident and generating the electricity is not always possible in the movable processing plant.

An object of the invention is to provide a processing method and plant by which drawbacks present in connection with prior art can be eliminated or at least reduced. A particular object of the invention is to enhance the cooling of the processing plant. A particular object of the invention is to enable as long as possible processing time.

SUMMARY

According to a first example aspect of the invention there is provided a mineral material processing method comprising processing mineral material in a mineral material processing plant; cooling, in a cooler of the processing plant, heat generated in heat sources of the processing plant and/or fuel used in a motor of the processing plant; directing wetting water (external to the cooler) to the mineral material (for example by spraying) for binding dust generated in the processing, and transferring to the wetting water heat of at least one heat source of the processing plant and/or heat of the fuel before using the wetting water for dust binding.

Preferably, the wetting water is directed, before the dust binding, to a heat exchanger for receiving heat in the wetting water and after that directing the wetting water to the dust binding.

Preferably, at least one of the following is cooled with the wetting water: hydraulic liquid of hydraulics, charge air of the motor, the fuel of the motor, cooling liquid of the motor of the processing plant. Preferably, the charge air of the motor is cooled with the wetting water in a cooling cell.

The heat source means in this description an apparatus that contributes directly or indirectly in heat generation in the processing plant, such as the motor, a lubrication apparatus, the hydraulics.

Preferably, heat transferred to the wetting water is transferred to a target of the processing plant which target needs heating and/or heat equalization, and after that the wetting water is directed to the dust binding. Preferably, the heat transferred to the wetting water is transferred to structures of a screen of the processing plant. Preferably, the warmed up wetting water is transferred through a bottom of the screen for frost-prevention of the screen. Preferably, the heat is transferred to the wetting water is transferred to structures of a feeder/conveyor of the processing plant. Preferably, the warmed up wetting water is directed through the structures of the feeder/conveyor for frost-prevention of the structures of the feeder/conveyor.

Preferably, cooling liquid of the motor and/or hydraulic liquid of the hydraulics that is/are cooled with the wetting water is directed to an additional cooler. Preferably, the hydraulic liquid of the hydraulics cooled with the wetting water is directed to a first additional cooler, for example a first additional cooling cell. Preferably, the cooling liquid of the motor cooled with the wetting water is directed to a second additional cooler, for example a second additional cooling cell.

Preferably, processing that generates a cooling need is screening and/or crushing and/or transporting by a conveyor of mineral material.

Preferably, heat transferred to the wetting water is stored in a heat storage and thereafter the wetting water is directed to the dust binding. Preferably, wetting water is directed, after the warming up thereof, through a second heat exchanger positioned in a liquid volume of the heat storage, heat of the wetting water is released to the liquid of the heat storage and after that the wetting water is directed to the dust binding. Preferably, the liquid volume of the heat storage is arranged to 200 to 1000 liters. Preferably, the liquid volume of the heat storage is insulated. The heat storage enables storing of the heat when the processing plant is not used. Preferably, heat stored in the heat storage is released to a target of the processing plant that needs heating and/or heat equalization, for example to heating of the hydraulic oil in cold circumstances and/or in connection with starting of a machine. The releasing of the heat can be implemented by the heat exchanger positioned in the liquid volume or by circuiting the liquid of the liquid volume. Preferably, a frost-proof liquid is arranged in the liquid volume.

According to a second example aspect of the invention there is provided a mineral material processing plant that comprises a motor and a cooler for cooling heat generated in heat sources of the processing plant and/or cooling fuel used in the motor of the processing plant, dust binding means for directing wetting water (that is external to the cooler) to the mineral material (for example by spraying) and for binding dust generated in the processing, and the processing plant comprises heat transfer means through which the wetting water is arranged to flow during use of the processing plant before directing the wetting water to the dust binding means, and the heat transfer means is configured to transfer to the wetting water heat of at least one heat source of the processing plant and/or heat of the fuel.

Preferably, the heat transfer means comprises a first heat exchanger that is arranged before the dust binding means in a flow direction of the wetting water.

Preferably, in the processing plant at least one of the following is arranged to be cooled with the wetting water: hydraulic liquid of hydraulics, charge air of the motor, the fuel of the motor, cooling liquid of the motor of the processing plant.

Preferably, heat transferred to the wetting water is arranged to be transferred to a target of the processing plant that needs heating and/or heat equalization (for example a screen, a feeder, a conveyor), and after that the wetting water is arranged to flow to the dust binding means.

Preferably, the processing plant comprises an additional cooler (for example a cooling cell which may be equipped with a blower) that is arranged to cool additionally the cooling liquid of the motor and/or the hydraulic liquid of the hydraulics in the heat transfer means after the cooling.

Preferably, the processing plant comprises a heat storage for receiving and storing heat transferred in the wetting water in the heat transfer means before the dust binding means.

Preferably, a heat exchanger is located in the heat storage for transferring heat of the wetting water to a liquid volume of the heat storage that is preferably insulated. The heat exchanger of the heat storage may be the said first heat exchanger or a separate second heat exchanger. The heat storage may be located in a bottom of a screen.

Without in any way limiting the scope, interpretation, or possible applications of the invention, a technical advantage of different embodiments of the invention is reduction of energy consumption and noise generation of the processing plant. As a further a technical advantage of different embodiments of the invention it may be considered an increase of efficient hours of production of the processing plant.

The cooling of a heat source of the processing plant such as the motor and the lubrication apparatus can be enhanced when the wetting water that before was used only in the dust binding is utilized comprehensively even in many targets that need cooling. Use of a hydraulically actuated cooler of the processing plant may be considerably reduced and as well as also thus the noise level of the motor. Better preconditions are generated for utilizing fully the capacity of the processing plant because the noise of the blower used in the cooling of the processing plant can be reduced. The rotation speed of the blower may be substantially smaller wherein the noise level is decreasing and the energy consumption is reduced.

As an additional advantage, the transferring of the heat to the wetting water used in the dust binding enhances operating conditions of the spraying particularly in winter circumstances. The "surplus energy" of the heat sources that is converted to heat can be transferred to the water of the dust binding. The energy of the heat sources that is converted to heat can be stored in the heat storage and can be used later, if necessary. The "heat storage" can be a "cold storage" in summer operation with a slight different implementation. The heat storage can be utilized additionally or alternatively to an external heater.

Mineral material processing may be implemented more economically than what is prior known when the surplus energy generated in the process is utilized. External heating of the wetting water can be eliminated or reduced in cold circumstances wherein energy consumption is decreases.

Different embodiments of the present invention will be illustrated or have been illustrated only in connection with some aspects of the invention. A skilled person appreciates that any embodiment of an aspect of the invention may apply to the same aspect of the invention and other aspects alone or in combination with other embodiments as well.

BRIEF DESCRIPTION OF THE DRAWINGS

The invention will be described, by way of example, with reference to the accompanying schematical drawings, in which.

DETAILED DESCRIPTION

In the following description, like numbers denote like elements. It should be appreciated that the illustrated drawings are not entirely in scale, and that the drawings mainly serve the purpose of illustrating some example embodiments of the invention.

Figure 3:
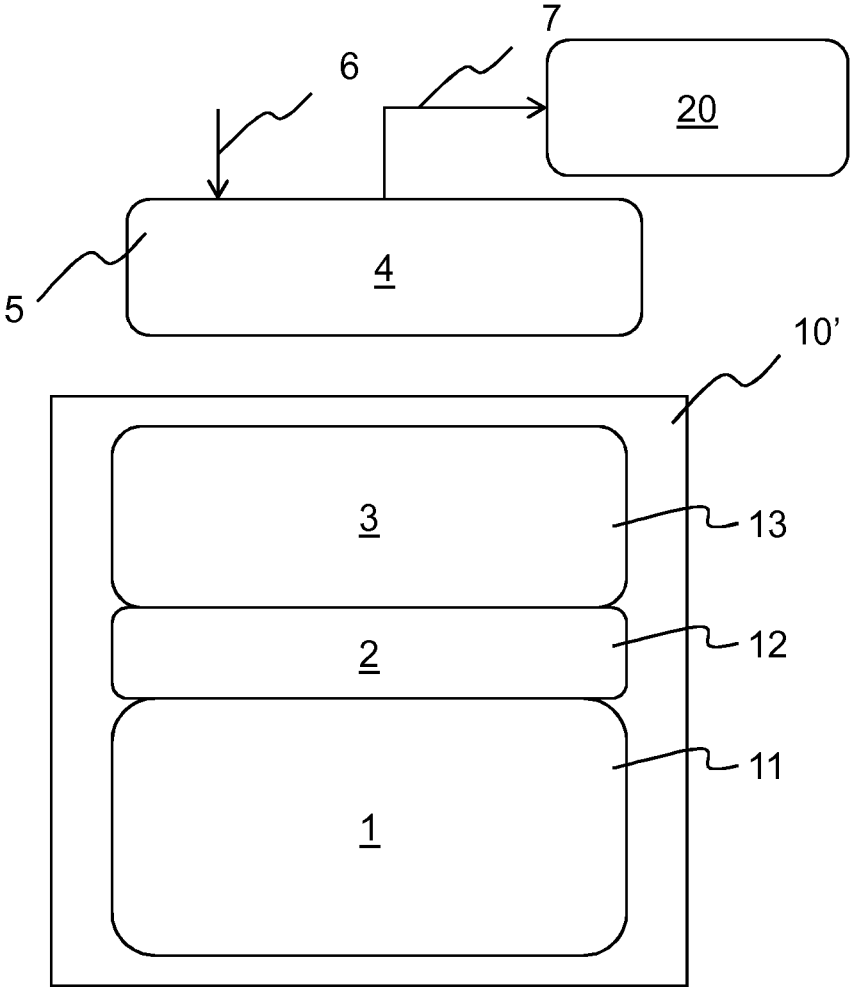
FIG. 3 shows a first example of a processing plant according to the invention.

FIG. 3 shows a cooling arrangement in which cooling 4 of hydraulics of a processing plant 200 is moved separate from a combination cell 10 of a cooler of the processing plant. The cooling 4 of the hydraulics is arranged in a first heat exchanger 5, and (cold) wetting water used for dust binding of mineral material flows to a first input 6 of the first heat exchanger. The wetting water flowing (warmed up) from an output 7 to dust binding means 20 of the processing plant to be used in dust binding. The wetting water is sprayed by the dust binding means 20 in a dust binding target of the processing plant such as a crushing chamber of a crusher.

A charge air cooling cell 11, a fuel cooling cell 12 and a motor cooling liquid cell 13 are arranged on top of each other in a layer-like combination cell 10' in the same structure in an influencing range of a blower (not shown in the Fig.). The charge air cooling cell 11 and the cooling liquid cooling cell 13 of the motor 104 can be increased significantly if the main dimensions of the cooler are kept unchanged. The rotation speed of the blower can be substantially smaller wherein the noise level is decreased and the energy consumption is reduced.

Figure 4:
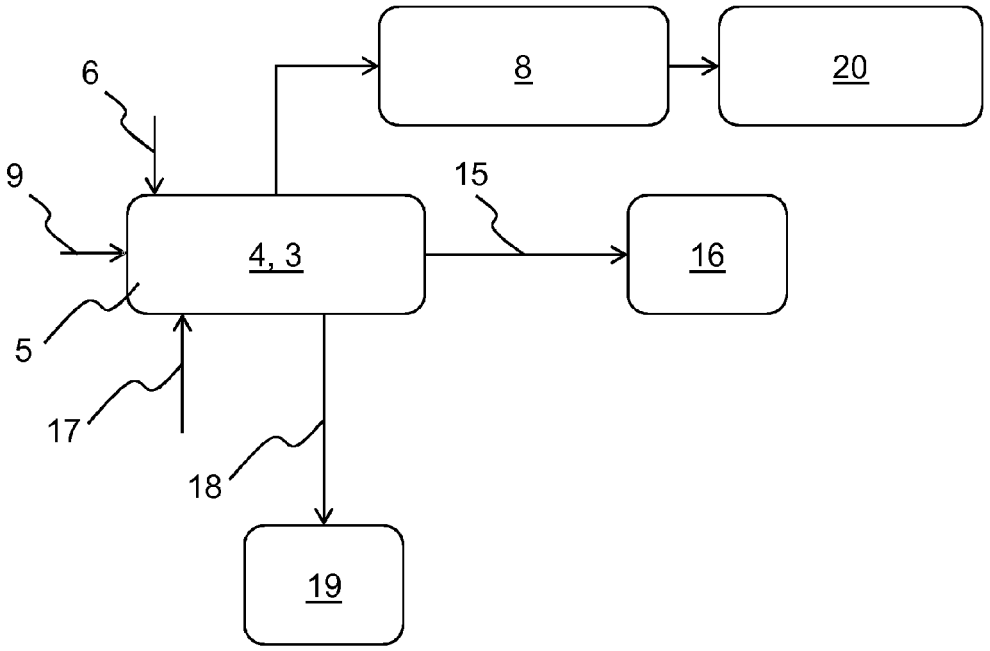
FIG. 4 shows a second example of a processing plant according to the invention.

FIG. 4 shows a cooling arrangement in which the source of the heat to be transferred to the wetting water is both the cooling system of the motor and the hydraulic system. The wetting water arriving from an external source warms up in a first heat exchanger 5 that comprises three pairs of inputs and outputs.

The (cold) wetting water used for dust binding of mineral material is connected to flow to a first input 6. As a difference with reference to the FIG. 3 it can be seen that heat content of the wetting water is utilized before the dust binding when the wetting water flows from a first output 7 to the dust binding means 20 through structures of a feeder 8. Heat of the wetting water is transferred before the dust binding to structures of the feeder 8 of the processing plant for frost-prevention of them. Accordingly, heat can be transferred, for example to structures of a screen or a conveyor of the processing plant before use of the wetting water in a dust binding target.

A cooling circuit 4 of the hydraulics is connected to a second input 9 of the heat exchanger 5. The cooled down hydraulic oil lows out of a second output 15 of the heat exchanger, if necessary to a first additional cooler 16, for example a first additional cooling cell.

The motor cooling liquid cooling circuit 3 is connected to a third input 17 of the heat exchanger 5. The cooled down motor cooling liquid is flowing out of a third output 18 of the heat exchanger, if necessary to a second additional cooler 19, for example a second additional cooling cell.

The first and second additional cooling cells 16, 19 can be arranged in the combination cell 10' of the type shown in FIG. 3 but because of the smaller cooling need the sizes thereof may be significantly small.

Figure 5:
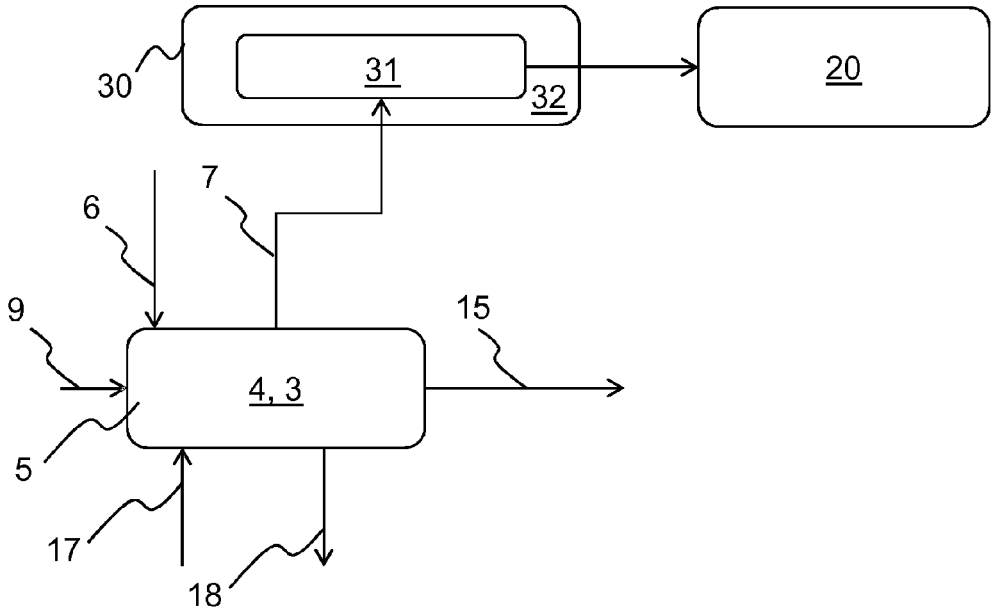
FIG. 5 shows a third example of a processing plant according to the invention.

FIG. 5 shows a cooling arrangement in which the sources of the heat to be transferred to the wetting water is both the cooling system of the motor and the hydraulic system. The wetting water proceeding from an external source warms up in a first heat exchanger 5 that comprises three pairs of inputs and outputs 6, 7; 9, 15; 17, 18 such as in FIG. 4.

Part of the heat of the wetting water is stored in a heat storage 30 by a second heat exchanger 31 in the example of FIG. 5. This arrangement enables storing of heat when the processing plant is not used. The warmed up wetting water is directed through the second heat exchanger 31 positioned in a liquid volume 32 of the heat storage 30, heat of the wetting water is released to the liquid of the heat storage and after that the wetting water is directed to the dust binding 20. Heat stored in the heat storage 30 can be released to a target of the processing plant that needs heating and/or heat equalization, for example to heating of the hydraulic oil in connection with starting of the machine.

Embodiments of the FIGS. 3, 4 and 5 can naturally be combined according to the invention and, among others, different combinations of heat sources and/or the fuel cooling circuit 2 can be connected to the first heat exchanger 5 as parties that release heat. Further, the heat transferred to the wetting water in the first heat exchanger 5 can be utilized in one or several targets that need heating and after that the wetting water can be used in connection with the dust binding. The first heat exchanger 5 can also be positioned in the heat storage 30.

Figure 1:
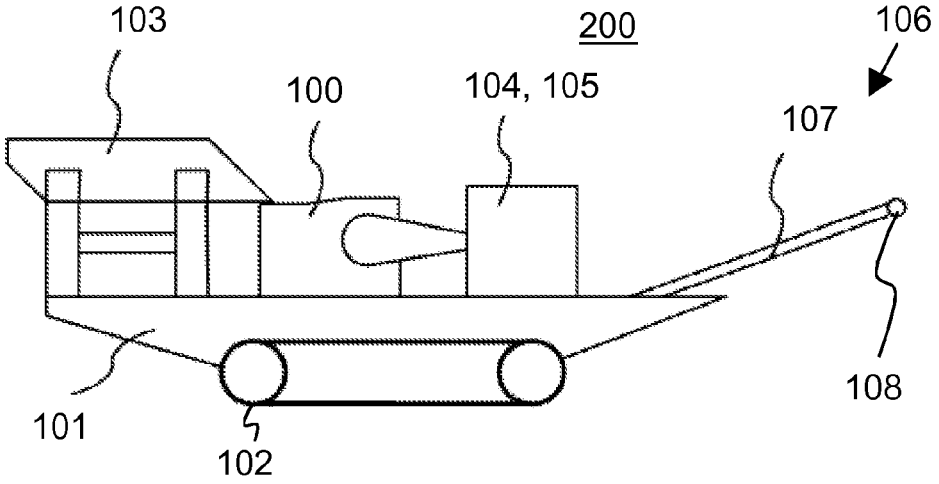
FIG. 1 PRIOR ART
FIG. 1 shows a side view of a crushing plant that is suitable for mineral material crushing.
Figure 2:
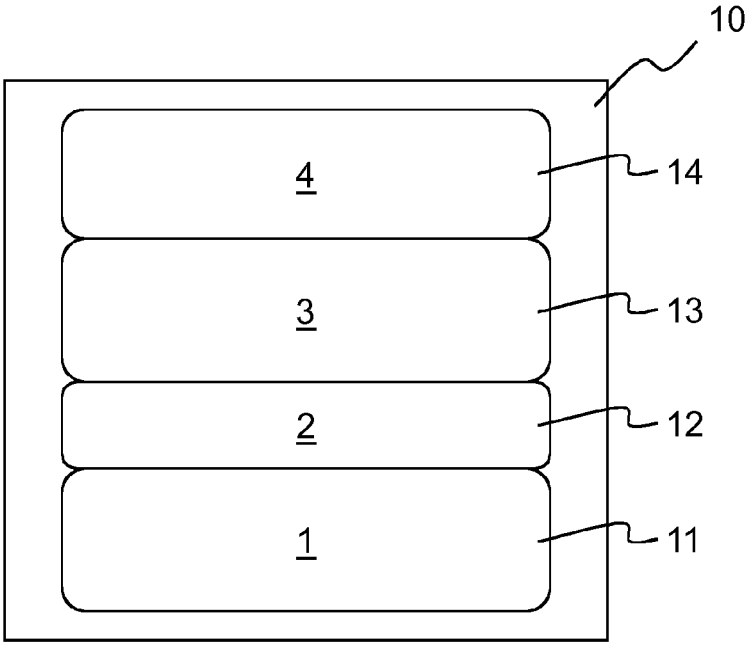
FIG. 2 PRIOR ART
FIG. 2 shows a known combination cell of a cooler.

Embodiments of the heat exchange system shown in FIGS. 3 to 5 can be used, for example, in the crushing plant 200 of FIG. 1.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of principles of the invention, and not in limitation thereof. Hence, the scope of the invention is only restricted by the appended patent claims.

The invention claimed is:

1. A mineral material processing method comprising:

processing mineral material in a mineral material processing plant;

cooling in a cooler of the processing plant at least one of heat generated in heat sources of the mineral material processing plant and fuel used in a motor of the mineral material processing plant;

cooling the cooler with a blower;

directing wetting water to the mineral material for binding dust generated during processing of the mineral material;

transferring to the wetting water heat of at least one heat source of the mineral material processing plant and/or heat of the fuel before using the wetting water for dust binding; and directing the wetting water in a flow direction before the dust binding to a first heat exchanger for receiving heat in the wetting water.

2. The method according to claim 1, further comprising cooling with the wetting water a plurality of cooling targets selected from a group consisting of:

the heat source of the processing plants;

charge air; and the fuel used in the motor.

3. The method according to claim 1, further comprising cooling with the wetting water at least one of the following: hydraulic liquid of hydraulics, charge air of the motor, the fuel of the motor, and cooling liquid of the motor of the mineral material processing plant.

4. The method according to claim 1, further comprising transferring heat transferred to the wetting water to a target of the mineral material processing plant that needs at least one of: heating, and heat equalization, and thereafter directing the wetting water to the dust binding.

5. The method according to claim 1, further comprising directing to an additional cooler at least one of the following that is cooled with the wetting water: cooling liquid of the motor and hydraulic liquid of the hydraulics.

6. The method according to claim 1, further comprising storing in a heat storage heat transferred to the wetting water and directing thereafter the wetting water to the dust binding.

7. The method according to claim 6, further comprising releasing heat stored in the heat storage to a target of the mineral material processing plant that needs at least one of: heating and heat equalization.

8. A mineral material processing plant comprising:

a motor;

a cooler equipped with a blower for cooling at least one of heat generated in heat sources of the processing plant and fuel used in the motor;

dust binding means for directing wetting water to the mineral material and for binding dust generated during processing of the mineral material; and heat transfer means through which the wetting water is arranged to flow during use of the mineral material processing plant before directing the wetting water to the dust binding means, the heat transfer means being configured to transfer to the wetting water heat of at least one heat source of the mineral material processing plant and/or heat of the fuel, wherein the heat transfer means comprises a first heat exchanger that is arranged before the dust binding means in a flow direction of the wetting water.

9. The mineral material processing plant according to claim 8, wherein the cooler is configured to cool with the wetting water a plurality of cooling targets selected from a group consisting of the heat sources of the mineral material processing plants, charge air, and the fuel used in the motor.

10. The mineral material processing plant according to claim 8, wherein the processing plant at least one of the following is arranged to be cooled with the wetting water: hydraulic liquid of hydraulics, charge air of the motor, the fuel of the motor, and cooling liquid of the motor of the mineral material processing plant.

11. The mineral material processing plant according to claim 8, wherein heat transferred to the wetting water is arranged to be transferred to a target of the mineral material processing plant that needs at least one of: heating and heat equalization, and the wetting water is arranged to flow thereafter to the dust binding means.

12. The mineral material processing plant according to claim 8, wherein the mineral material processing plant comprises an additional cooler which is arranged to cool additionally at least one of: the cooling liquid of the motor and the hydraulic liquid of the hydraulics in the heat transfer means after the cooling.

13. The mineral material processing plant according to claim 8, wherein the mineral material processing plant comprises a heat storage configured to receive and store heat transferred in the wetting water in the heat transfer means before the dust binding means.

14. The mineral material processing plant according to claim 13, wherein a first heat exchanger or a second heat exchanger is positioned in the heat storage for transferring heat of the wetting water to a liquid volume of the heat storage.

15. The mineral material processing plant according to claim 13, wherein the heat storage is positioned in a bottom of a screen.

16. A mineral material processing plant comprising:

a motor;

a cooler including a blower operable to remove heat from one of a plurality of heat sources of the processing plant and fuel used in the motor;

a heat exchanger operable to receive a supply of wetting water, wherein the heat exchanger transfers heat from the plurality of heat sources and/or the fuel to the supply of wetting water to create a heated supply of wetting water; and a dust binding means operable to receive the heated supply of wetting water and to direct the heated supply of wetting water to bind dust generated during operation of the mineral material processing plant.

17. The mineral material processing plant according to claim 16, further comprises a heat storage device that receives the heated supply of wetting water and removes and stores heat from the heated supply of water.

* * * * *